US006536682B1

(12) United States Patent
Schnupp et al.

(10) Patent No.: US 6,536,682 B1
(45) Date of Patent: Mar. 25, 2003

(54) ACTUATOR COMPONENT FOR A MICROSPRAY AND ITS PRODUCTION PROCESS

(75) Inventors: Ralf Schnupp, Herzogenaurach (DE); Jochen Thomas, Nuernberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 10/049,195

(22) PCT Filed: Aug. 10, 2000

(86) PCT No.: PCT/EP00/07798

§ 371 (c)(1),
(2), (4) Date: Jun. 17, 2002

(87) PCT Pub. No.: WO01/12340

PCT Pub. Date: Feb. 22, 2001

(30) Foreign Application Priority Data

Aug. 12, 1999 (DE) ..... 199 38 055

(51) Int. Cl.[7] ..... F04B 43/04

(52) U.S. Cl. ..... 239/102.2; 239/102.1; 239/4; 239/596; 239/491; 239/494

(58) Field of Search ..... 239/102.1, 102.2, 239/4, 596, 491, 494

(56) References Cited

U.S. PATENT DOCUMENTS

| | | | | | |
|---|---|---|---|---|---|
| 4,605,167 | A | * | 8/1986 | Maehara | 239/102.2 |
| 5,152,456 | A | * | 10/1992 | Ross et al. | 239/102.2 |
| 5,487,378 | A | * | 1/1996 | Robertson et al. | 128/200.16 |
| 5,518,179 | A | * | 5/1996 | Humberstone et al. | 239/102.2 |
| 5,529,055 | A | | 6/1996 | Gueret | 128/200.16 |
| 5,685,491 | A | * | 11/1997 | Marks et al. | 239/533.12 |
| 5,823,428 | A | * | 10/1998 | Humberstone et al. | 239/4 |

FOREIGN PATENT DOCUMENTS

| | | |
|---|---|---|
| DE | 694 04 004 T2 | 12/1994 |
| DE | 198 02 368 C1 | 8/1999 |
| EP | 0 465 229 A1 | 1/1992 |
| WO | WO 95/15822 | 6/1995 |

* cited by examiner

*Primary Examiner*—Timothy L. Maust
*Assistant Examiner*—Azy Kokabi
(74) *Attorney, Agent, or Firm*—Glenn Patent Group; Michael A. Glenn

(57) ABSTRACT

An actuator component for a piezoelectrically-driven microatomizer comprises a diaphragm formed in a semiconductor substrate, a piezoelectric actuator which is arranged on a surface of the diaphragm and by means of which the diaphragm can be caused to vibrate, and a passage formed in the semiconductor substrate and used for supplying a liquid to be atomized from an inlet end to the diaphragm surface located opposite the piezoelectric actuator.

14 Claims, 2 Drawing Sheets

Fig. 1b
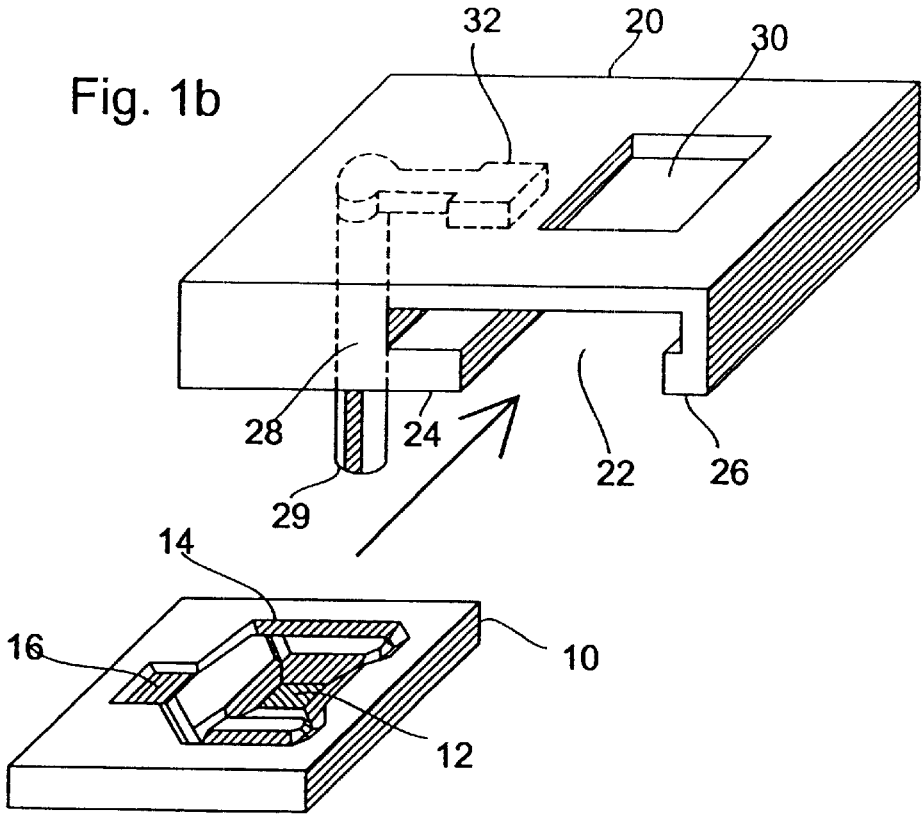
Fig. 1a
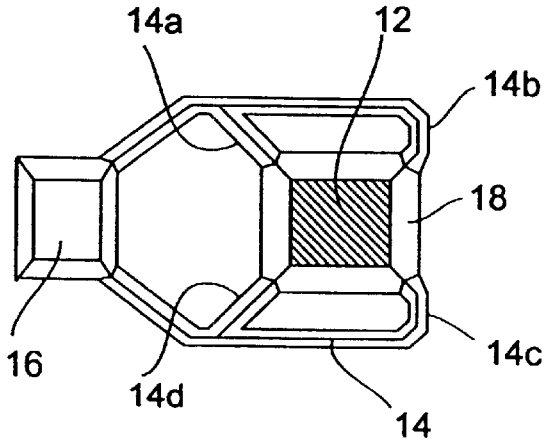
Fig. 2a
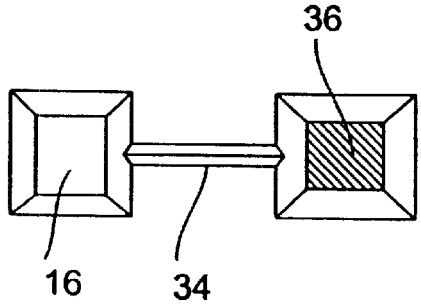
Fig. 2b

ACTUATOR COMPONENT FOR A MICROSPRAY AND ITS PRODUCTION PROCESS

BACKGROUND OF THE INVENTION

1. Field of the Invention

The present invention relates to an actutor for a microatomizer and, in particular, to an actuator component for a piezoelectrically operated microatomizer, to methods of producing such an actuator component as well as to a microatomizer which makes use of such an actuator component.

2. Description of Prior Art

Elements for atomizing liquid media, which will simply be abbreviated to atomizers in the following, are used in many technical fields, e.g. in the cosmetic industry for atomizing hair sprays and perfumes, in the field of medicine as medicament sprays, in connection with various coating techniques for atomizing varnishes and adhesives, in the field of chemistry for atomizing liquid reagents, and in the field of domestic engineering as room air humidifiers.

Most of the atomizers used at present work by means of mechanical atomization in the case of which the liquid is pressed through a valve of suitable shape and size due to a mechanically generated overpressure. This has the effect that the medium, i.e. the liquid to be atomized, is discharged in the form of small droplets, in most cases statistically distributed, and forms a mist of liquid. The necessary overpressure is produced manually by a pumping process, e.g. in perfume atomizers, or by the use of excess pressure reservoirs, e.g. propellants in hair sprays.

In addition to the above-described mechanical systems, also electrically driven nebulizers exist; these electrically driven nebulizers are based on piezoelectric substrates which are electrically caused to vibrate. In the course of this process, a liquid on the surface of the piezoelectric substrate is atomized by the capillary waves produced.

In "Micromechanical Ultrasonic Liquid Nebulizer" written by R. Paneva et al, Sensors and Actuators A 62 (1997), pp. 765 to 767, a piezoelectric atomizer is described in which a thin silicon diaphragm is caused to vibrate by means of a piezoelectric ZnO layer; in the course of this process, liquids are atomized by the thin silicon diaphragm. The atomizer described in this publication operates at a vibrational frequency of 80 to 86.5 kHz, the atomizer disclosed there producing droplets of very different diameters.

All the existing mechanical and piezoelectric systems have one main drawback insofar as the droplet diameters vary over a wide range. Especially in medical applications, this is a severe drawback. Droplets can only be taken up by the lungs when they have a diameter of approx. 1 to 5 $\mu$m. All the known systems achieve this only to a certain extent so that the commercially available atomizers have an efficiency of only 10% up to 15% at the most, i.e., when known atomizers are used, a volume which is ten times as large must be atomized so that the amount of medicament required for the patient will be transferred to the patient's lungs. In addition, the volume atomized in individual dosing processes varies over a large range in known atomizers.

All the known mechanical atomizers have the additional drawback that nozzles have to be used which clog very easily. This is the reason for the fact that mechanical systems are always throw-away products. Moreover, the use of nozzles increases the likelihood of maloperation, a circumstance which, especially from the medical point of view, is disadvantageous or even dangerous in acute situations.

In "Flüissigkeitszerstäubung durch Ultraschall", in Elektronik October 1979, pp. 83 to 86, the ultrasonic atomizing effect is described, which functions according to the principle of capillary wave theory.

DE 19802368 C1 describes a microdosing device in which a pressure chamber is delimited by a diaphragm on one side thereof, the pressure chamber having provided therein an inlet opening and an outlet opening. Suitable driving of the diaphragm has the effect that, for a dosing process, fluid is sucked in through the inlet opening and ejected through the outlet opening. This microdosing device operates on the basis of a displacement effect, but not on the basis of the capillary wave theory.

DE 69404004 T2 discloses a piezoelectric nebulizer in which the liquid is applied to an atomization grid, which is caused to vibrate; for applying the liquid, a soft component having a capillary or feltlike structure, such as an open-cell foam, is used.

In WO-A-95/15822 an atomizing device is described, which is based on an atomization making use of the capillary wave theory. A diaphragm is here caused to vibrate so as to effect the atomization. A liquid to be atomized is supplied through openings in the diaphragm, which fully penetrate the whole diaphragm, to the diaphragm surface from which the liquid is atomized.

SUMMARY OF THE INVENTION

It is the object of the present invention to provide a microatomizer permitting, on the one hand, mass production, and, on the other hand, the atomization of defined-diameter droplets with increased efficiency, as well as a method for producing such a microatomizer.

According to a first aspect of the invention this object is achieved by a piezoelectrically-driven, capillary wave-theory microactuator comprising:

- a diaphragm formed in a semiconductor substrate;
- a piezoelectric actor arranged on a surface of the diaphragm so as to cause said diaphragm to vibrate; and
- a passage formed in said semiconductor substrate and used for supplying a liquid to be atomized from an inlet end to the diaphragm surface located opposite to said piezoelectric acuator, wherein, due to the vibrations of the diaphragm, the liquid supplied to the surface of the diaphragm is atomized on the basis of the capillary-wave theory and ejected through an outlet arranged in opposed relationship with said diaphragm, said passage being formed by at least one groove-like structure which does not fully penetrate the substrate and which is provided in the surface of the substrate from which the liquid supplied is atomized.

The actuator component used in the atomizer according to the present invention makes use of the piezoelectric principle. For this purpose, a piezoelectric layer produced preferably in thin-film technology is used for deflecting a thin diaphragm which is preferably etched in silicon, the thin diaphragm being caused to vibrate in this way. The silicon substrate, in which the diaphragm is formed, has additionally formed therein a passage means which serves to supply the liquid to be atomized so as to cause a substantially uniform wetting of the diaphragm surface located opposite the piezoelectric actuator. Due to the fact that liquid is supplied through the passage means according to the present invention in such a way that the diaphragm is wetted in a substantially uniform manner, the droplet diameters are prevented from varying over a wide range in accordance with the present invention. The actuator component of the atomizer according to the present invention is preferably adapted to be driven at a frequency between 2 and 2.5 MHz and in such a way that the droplets produced by the atomization have a diameter between 1 and 5 $\mu$m. In order to achieve this, the geometrical dimensions of the diaphragm, the supply of liquid as well as the vibration frequency used are suitably adapted as atomization parameters for adjusting a desired droplet size.

Depending on the size of the diaphragm, it may be of advantage in accordance with the present invention to implement the passage means such that it will supply the liquid to be atomized to the diaphragm from different directions. The diaphragm may, for example, be rectangular, the passage means supplying the liquid to be atomized then via the four corners of the diaphragm.

A microatomizer according to the present invention making use of such an actuator may comprise a holder to which the actor component is fixed in such a way that the inlet end is in fluid communication with a fluid supply conduit, that the passage means is sealed by the holder with the exception of a fluid communication existing between the passage means and a fluid supply conduit and the passage means and the diaphragm surface located opposite the piezoelectric-actuator, and that an opening of the holder is provided in the area of the diaphragm surface located opposite the piezoelectric-actuator, the opening being used for ejecting the atomized liquid.

The holder is implemented such that the actuator can easily be attached thereto, the fluid supply conduit leaving the holder preferably in a direction opposite to the ejection direction of the atomized liquid.

According to a further aspect of the present invention, the above object is achieved by method of producing a piezoelectrically-driven, capillary wave-theory microatomizer used for atomizing on the basis of the capillary-wave theory a liquid supplied to a surface of a diaphragm, said method comprising the following steps:

a) producing an actuator by the following sub-steps:
   a1) applying a piezoelectric actuator to a main surface of a semiconductor substrate;
   a2) patterning the semiconductor-substrate main surface located opposite the piezoelectric actuator so as to define therein the diaphragm which has arranged thereon the piezoelectric actuator, and at least one passage in the form of a groove like structure which does not fully penetrate the substrate and which extends from an inlet end to said diaphragm; and
b) fixing the actuator to a holder such that the diaphragm surface located opposite the piezoelectric actuator faces an opening in said holder.

It follows that the present invention provides an actuator for a piezoelectrically driven microatomizer, which, due to the use of use of micromechanical means and especially due to the use of silicon technology, permits a very small and economy-priced system that can be produced in very large numbers of pieces. The above-described properties of the atomizer have the effect that the distribution of the droplets, the precision of the volume to be atomized and thus, in the case of medical applications, the medical efficiency are improved substantially. The actuator does not need a nozzle so that clogging effects are excluded. The system is therefore also suitable to be used more than once; in this case, it will suffice to exchange a fluid reservoir which is connected to the fluid supply line. In view of the fact that the piezodrive needs little energy, energy consumption is reduced as well.

Further developments of the present invention are specified in the dependent claims.

BRIEF DESCRIPTION OF THE DRAWINGS

In the following, preferred embodiments of the present invention will be explained in detail making reference to the drawings enclosed, in which:

FIG. 1*a*) shows a schematic perspective, representation of an embodiment of an actuator according to the present invention;

FIG. 1*b*) shows a schematic perspective representation of a holder of a microatomizer according to the present invention;

FIGS. 2*a*) and 2*b*) show schematic representations for explaining different embodiments of passage means of actuator according to the present invention.

DESCRIPTION OF PREFERRED EMBODIMENTS OF THE INVENTION

Figure 3:
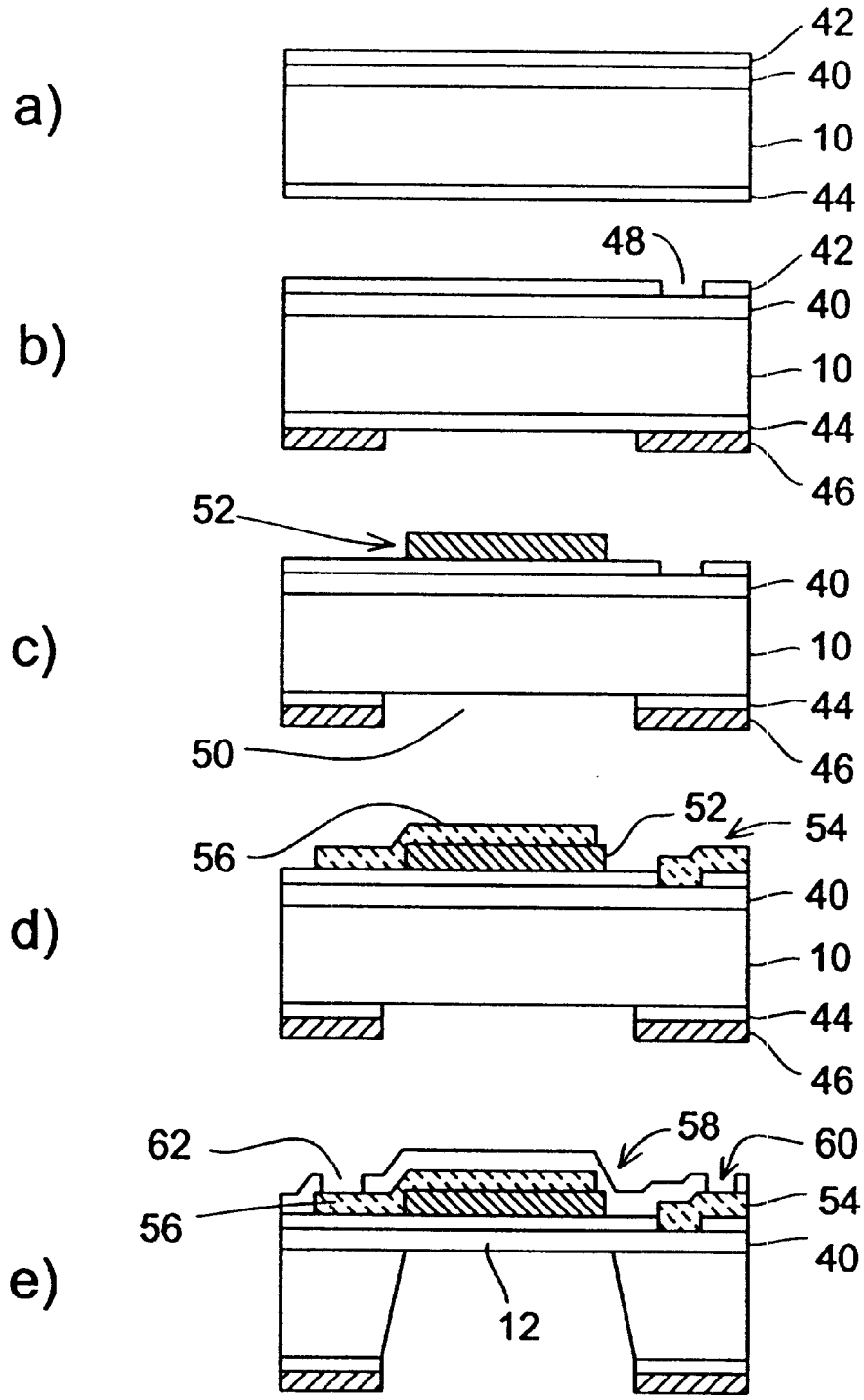
FIGS. 3*a*) and 3*e*) show schematic sectional views for illustrating the method of producing an actuator according to the present invention.

FIG. 1*a*) shows a schematic perspective view of an embodiment of an actuator in the case of which a diaphragm 12 is formed in a main surface of a silicon substrate 10. A schematic top view of the embodiment shown in FIG. 1*a*) is additionally shown in FIG. 2*a*); the description following hereinbelow will be continued making reference to FIGS. 1*a*) and 2*a*). In these figures, the respective atomization surface of the diaphragm 12 is visible so that the piezoelectric actuator arranged on the opposite surface of the diaphragm cannot be seen in these figures. The piezoelectric actuator serves to cause the diaphragm 12 to vibrate. The substrate surface having formed therein the recess which defines the diaphragm 12 has additionally formed therein a passage means 14 through which a liquid to be atomized can be fed to the atomization surface of the diaphragm 12. Furthermore, a recess 16 serving as a media inlet is provided in this main surface of the silicon substrate 10.

The passage means 14 provides fluid communication between the media inlet 16 and the atomization surface of the diaphragm 12 so as to permit a substantially uniform wetting of the atomization surface with the liquid to be atomized. For this purpose, the passage means 14 of the embodiment shown comprises passage sections 14*a*, 14*b*, 14*c* and 14*d* which supply the liquid to be atomized from the direction of the four corners of the substantially rectangular diaphragm 12 to the atomization surface thereof. It should here be pointed out that, in the embodiment shown, the diaphragm 12 is defined by a diaphragm recess, which has been formed by means of a KOH etching process in such a way that the lateral walls 18 of the diaphragm recess are inclined at an angle of approx. 55°, as can be seen in FIG. 1*a*). As can also be seen in this figure, sections 14*a*, 14*b*, 14*c* and 14*d* of the passage means 14 end in the respective upper area of the inclined lateral surfaces 18 in such a way that the supply of the medium to be atomized takes place via these inclined lateral surfaces 18. In addition, it should be noted that also the media inlet recess 16 as well as the passage means 14 can be formed by means of KOH etching.

An actuator having the structural design shown e.g. in FIG. 1*a*) is now inserted into a holder so as to build a microatomizer, said type of holder being shown e.g. in FIG. 1*b*). For this purpose, the holder 20 comprises a reception compartment 22 into which the actuator is introduced and in which it can be secured in position in a suitable manner. For this purpose, the holder 20 is preferably provided with protrusions 24 and 26 which hold the actuator. Furthermore, the holder 20 is implemented such that, together with the actuator component, it defines closed passages which are in fluid communication with the atomization surface of the diaphragm 12 and the media inlet 16. In addition, the holder 20 is preferably provided with a means 28 for connecting thereto a fluid conduit 29, preferably a hose, such that the fluid conduit 29 is in fluid communication with the media inlet 16. The holder 20 is additionally provided with an opening 30 which, when the actuator is mounted in the holder 20, is arranged above the atomization surface of the diaphragm 12 so as to permit ejection of the atomized liquid. The fluid conduit 29 is arranged relative to the opening 30 preferably in such away that the opening 30 can be arranged e.g. in a breathing passage of an inhalator. For this purpose, the fluid conduit 29 leaves the holder 20 preferably opposite to the opening 30, as can be seen in FIG. 1*b*). In alternative embodiments, the opening 30 can be provided with a grid guaranteeing e.g. a precisely defined size of the droplets or permitting overhead operation of the system.

The actuator shown in FIG. 1*a*) consists preferably of silicon, whereas the holder shown in FIG. 1*b*) can be produced from plastic material, which will be of advantage with respect to the price of the system, or from any other suitable material. The actuator component can be attached to the holder e.g. by means of anodic bonding methods; such anodic bonding methods can also be used for establishing a very firm, tight and stable connection to a further silicon chip, which, in turn, may comprise suitable passages and fluid connections.

In the holder shown in FIG. 1*b*), a possibility of establishing fluid communication between the means 28 used for connecting a fluid conduit, and the media inlet 16 is shown in broken lines. It should here be pointed out that, when a suitable recess 32 is provided in the holder 20, the media inlet recess 16 in the substrate 10 of the actuator can be dispensed with, provided that the passage means 14 ends below the recess 32 so that fluid communication is guaranteed in this way.

When the atomizer is in operation, the atomization surface of the diaphragm 12 is wetted uniformly with the liquid to be atomized via the fluid conduit 29, the media inlet 16 and the passage means 14. For this purpose, the fluid conduit 29 is connected to a liquid reservoir (not shown), which is preferably an excess pressure container; fluid communication can be established between this excess pressure container and the fluid conduit 29 via a valve. The diaphragm 12 is caused to vibrate by means of the piezoelectric-actuator so that the liquid on the atomization surface of the diaphragm 12 will be atomized on the basis of the capillary wave theory. During the atomization process, atomization liquid is supplied continuously via the passage means 14.

Due to this course of action, the actuator according to the present invention can be used for carrying out an atomization resulting in droplets whose diameters do not vary over a large range, but can be kept in a defined range, for medical engineering preferably between 1 and 5 $\mu$m. Droplets of this order of magnitude are obtained making use of an excitation frequency of the piezoelectric-actuator in the range of 2.0 to 2.5 MHz, the exact value of the excitation frequency depending to a minor degree on the viscosity of the liquid to be atomized.

FIG. 2*b*) shows a schematic top view of a passage means 34 which can suffice for a small-sized diaphragm 36 so that uniform wetting of the diaphragm with the liquid to be atomized is still effected. The passage means 34 is again in fluid communication with a recess 16 defining a media inlet. The arrangement shown in FIG. 2*b*) is suitable for atomizing small fluid volumes, whereas the embodiment shown in FIG. 2*a*) is suitable for atomizing larger fluid volumes.

Due to the reduction of cross-sectional area, the passages 14 and 34 serve both as fluid supply means and as flow restrictors. In the case of a constant output pressure of the liquid and due to the passages which are produced with precise cross-sectional areas, a constant flow to the piezoelectric diaphragms 12 and 36, respectively, is obtained. In this connection, it should be taken into account that the passages according to the present invention can be etched precisely by means of silicon technology so that liquid can be supplied in defined amounts to the atomization surface of the diaphragm. It follows that, by selecting different cross-sections, the microactuators can purposefully be adjusted to the desired flow quantities so that very precisely defined volumes can be atomized.

When the device according to the present invention is used in medical applications, attention should be paid to the biocompatibility of the components coming into contact with the liquids. Exposed surfaces, which may come into contact with the liquids, are provided with a protective layer consisting preferably of titanium or titanium nitride.

In the following, a method of producing an actuator according to the present invention will be described making reference to FIGS. 3*a*) to 3*e*).

The basic material used for the actuator is preferably a monocrystalline silicon substrate 10 which can be n-doped or p-doped. On a surface of the silicon substrate 10 an ion implantation, e.g. with phosphorus, is carried out so as to produce a diaphragm layer 40. The material used as a silicon substrate 10 is preferably a p-type silicon, whereas the layer 40 is an n-type layer. The layer 40 will later serve as a lower electrode for driving the piezoelectric layer. The substrate 10 having arranged thereon the implantation layer 40 is subsequently subjected to oxidation so as to produce the $SiO_2$ layers 42 and 44. The resultant composite layer is shown in FIG. 3*a*).

On the back, a masking layer 46 is now formed, which preferably consists of silicon nitride $Si_3N_4$ and which is preferably formed by chemical deposition, e.g. LPCVD (=Low Power Chemical Vapour Deposition). In the upper oxide layer 42 an opening 48 is formed through which the implantation layer 40 will be contacted later on, cf. FIG. 3*b*).

The lower oxide layer 44 and the silicon nitride layer 46 are patterned, e.g. by photolithographic processes, so as to define an opening 50 so that the diaphragm recess can be etched free from the lower surface of the silicon substrate 10 later on. Above this opening 50, a piezoelectric material 52 is applied to the upper oxide layer 42, the piezoelectric material acting as a piezoelectric actuator in the finished component. The piezoelectric material may consist e.g. of AlN, PZT or ZnO. The structure shown in FIG. 3*c*) is obtained in this way.

Subsequently, the metallizations 54 and 56 for electrically driving the piezoelectric element 52 are produced on the upper surface of the structure shown in FIG. 3*c*), cf. FIG. 3*d*), whereupon a passivation layer 58 is applied and patterned so as to define openings 60 and 62 for contacting the metallizations 54 and 56, cf. FIG. 3*e*). Following this, KOH etching, which is limited by the masking layers deposited on the front and on the back, is executed from the back down to the implantation layer 40 serving as an etch stop, so that the diaphragm 12, which is formed in the implantation layer 40, is produced.

Although not shown in FIG. 3, the integrated low-depth flow passages and the necessary depressions for the media inlet can simultaneously by produced during this KOH etching. Starting from the condition shown in FIG. 3*e*), the lower masking layers 44 and 46 are, alternatively, patterned still further so as to define the passages and the media inlet, whereupon further KOH etching is carried out so as to produce the passages and the media inlet in the back of the silicon substrate 10.

Although a preferred embodiment of the method for producing an actuator according to the present invention has been described hereinbefore with reference to FIG. 3, it is apparent to those skilled in the art that the above-described steps can also be taken in a different sequence so as to produce the structure of the actuator according to the present invention, as shown e.g. in FIG. 1*a*), in a main surface of a silicon substrate and, in addition, a piezoelectric drive on the opposite main surface of the silicon substrate.

According to the present invention, it is only important that the recess defining the diaphragm, and the supply passages guaranteeing a uniform wetting of the atomization surface of the diaphragm are formed in the same main surface of a silicon substrate so that the present invention permits mass production of small-sized actuators at a moderate price and with little energy consumption.

What is claimed is:

1. A piezoelectrically-driven, capillary wave-theory microactuator comprising:

a diaphragm formed in a semiconductor substrate;

a piezoelectric actuator arranged on a surface of the diaphragm so as to cause said diaphragm to vibrate; and a passage formed in said semiconductor substrate and used for supplying a liquid to be atomized from an inlet end to the diaphragm surface located opposite to said piezoelectric actuator, wherein, due to the vibrations of the diaphragm, the liquid supplied to the surface of the diaphragm is atomized on the basis of the capillary-wave theory and ejected through an outlet arranged in opposed relationship with said diaphragm, said passage being formed by at least one groove-like structure which does not fully penetrate the substrate and which is provided in the surface of the substrate from which the liquid supplied is atomized.

2. A microactuator according to claim 1, wherein the diaphragm and the passage are formed by recesses in a first main surface of the semiconductor substrate.

3. A microactuator according to claim 1, wherein the first main surface of the semiconductor substrate has additionally formed therein a recess which defines a liquid inlet and which is in fluid communication with the inlet end of the passage.

4. A microactuator according to claim 1, wherein the passage is implemented such that uniform wetting of the diaphragm surface located opposite the piezoelectric actuator is caused.

5. A microactuator according to claim 1, wherein the passage is implemented such that a liquid to be atomized will be supplied to the diaphragm from different directions.

6. A microactuator according to claim 5, wherein the diaphragm has a rectangular shape, said passage comprising passage sections which serve to supply the liquid to be atomized to the diaphragm via the four corners.

7. A microactuator according to claim 1, wherein the piezoelectric actuator causes the diaphragm to vibrate at frequencies between 2 and 2.5 MHz in such a way that the droplets produced by the atomization have diameters between 1 and 5 $\mu$m.

8. A microactuator according to claim 1, wherein the passage is implemented as a defined flow restrictor.

9. A microactuator according to claim 1, comprising a holder to which the semiconductor substrate is fixed in such a way that the inlet end is in fluid communication with a fluid supply conduit;

the passage is sealed by the holder with the exception of a fluid communication existing between said passage and the fluid supply conduit and said passage and the diaphragm surface located opposite the piezoelectric actuator and an opening of said holder is provided in the area of the diaphragm surface located opposite the piezoelectric actuator, said opening being used for ejecting the atomized liquid.

10. A microactuator according to claim 9, wherein the fluid supply conduit is arranged such that it leaves the holder in a direction opposite to the ejection direction of the atomized liquid.

11. A microactuator according to claim 9, wherein the holder is provided with a recess which serves as a fluid inlet.

12. A method of producing a piezoelectrically-driven, capillary wave-theory microatomizer used for atomizing on the basis of the capillary-wave theory a liquid supplied to a surface of a diaphragm, said method comprising the following steps:

a) producing an actuator by the following sub-steps:

a1) applying a piezoelectric actuator to a main surface of a semiconductor substrate;

a2) patterning the semiconductor-substrate main surface located opposite the piezoelectric actuator so as to define therein the diaphragm which has arranged thereon the piezoelectric actuator, and at least one passage in the form of a groove-like structure which does not fully penetrate the substrate and which extends from an inlet end to said diaphragm; and b) fixing the actuator to a holder such that the diaphragm surface located opposite the piezoelectric actuator faces an opening in said holder.

13. A method according to claim 12, wherein, in step a2), a fluid inlet is additionally patterned in the surface of the semiconductor substrate located opposite the piezoelectric actuator said fluid inlet being in fluid communication with the passage at the inlet end of said passage.

14. A method according to claim 12, wherein the diaphragm is formed by KOH etching, the passage being produced such that it extends up to the inclined lateral walls of the recess defining the diaphragm, said lateral walls being formed by said KOH etching.

* * * * *